US008197120B2

(12) United States Patent
Westmoreland et al.

(10) Patent No.: US 8,197,120 B2
(45) Date of Patent: Jun. 12, 2012

(54) DEVICE FOR AUTOMATICALLY SHAKING AN INHALER

(75) Inventors: David Westmoreland, Runcorn (GB); Sean Scott, Runcorn (GB)

(73) Assignee: Astech Projects Limited, Runcorn (GB)

( * ) Notice: Subject to any disclaimer, the term of this patent is extended or adjusted under 35 U.S.C. 154(b) by 1035 days.

(21) Appl. No.: 12/138,325

(22) Filed: Jun. 12, 2008

(65) Prior Publication Data

US 2008/0316857 A1 Dec. 25, 2008

(30) Foreign Application Priority Data

Jun. 21, 2007 (GB) ..... 0711997.7

(51) Int. Cl.
*B01F 11/00* (2006.01)

(52) U.S. Cl. ..... 366/240; 366/209; 366/212; 366/218; 366/214; 366/110; 366/111; 366/116; 366/184; 366/189

(58) Field of Classification Search ..... 366/209, 366/212, 218, 240, 214, 110, 111, 112, 116, 366/184, 189, 191
See application file for complete search history.

(56) References Cited

U.S. PATENT DOCUMENTS

2002/0081748 A1 6/2002 Roberts et al.
2004/0226555 A1* 11/2004 Scarrott et al. ..... 128/200.23
2004/0231667 A1* 11/2004 Horton et al. ..... 128/202.13

FOREIGN PATENT DOCUMENTS

GB 2371861 8/2002
WO WO-01-28615 4/2001
WO WO 2006/097747 A1 9/2006

* cited by examiner

*Primary Examiner* — Yogendra Gupta
*Assistant Examiner* — Ninh Le
(74) *Attorney, Agent, or Firm* — Blakely, Sokoloff, Taylor & Zafman LLP.

(57) ABSTRACT

The invention is concerned with testing of inhalers used for medicament delivery. Such devices are often intended to be first shaken by a user to prepare them, and then fired by operation of some mechanical mechanism. In order to automate testing, the invention provides a shake device having a carriage 14 for receiving and releasably mounting one or more inhalers. The carriage is mounted upon a guideway for linear movement upon it. A linear motor 26 is operatively coupled to the carriage to reciprocally drive it to shake the mounted inhaler(s). A system embodying the invention may further comprise a fire device having a movable firing member 54, 56 for engaging with an inhaler mounted in the carriage and actuating its firing mechanism.

16 Claims, 9 Drawing Sheets

DEVICE FOR AUTOMATICALLY SHAKING AN INHALER

CROSS-REFERENCE TO OTHER APPLICATIONS

The present patent application claims priority from United Kingdom Patent Application No. 0711997.7, filed on Jun. 21, 2007.

BACKGROUND OF THE INVENTION

The present invention is concerned with testing of inhalers used for medicament delivery, and more particularly with devices for automatically shaking and firing an inhaler for testing purposes.

Inhalers for pharmaceutical delivery are in themselves well known and widely used for the treatment of various conditions including asthma. An inhaler typically has a mouthpiece (or in some cases a nasal nozzle), some form of storage for the medicament itself, and a manually actuable mechanism for releasing a dose of the medicament. Some inhalers are intended to be shaken before the dose of medicament is dispensed. This is the case for so-called "metered dose inhalers" (MDIs), which have a manually actuated mechanism for releasing a controlled dose from a larger reservoir of the medicament, and which typically also use a compressed propellant to eject this dose through the inhaler's mouthpiece. One such inhaler is described in detail in international patent application PCT/GB2006/000966, filed in the name of Glaxo Group Limited and published under WO 2006/097747. It has a housing which serves to mount the mouthpiece and which contains a cylinder of pressurised propellant, and a valve mechanism which is actuated by the user by means of two pivotally mounted arms which are squeezed together in one hand to release a dose of medicament into the user's mouth for inhalation.

SUMMARY OF THE INVENTION

Testing of sample inhalers is carried out routinely by manufacturers to ensure that they consistently meet certain requirements with regard to dispensed dose, etc. The procedure involves test firing the inhaler and collecting the dispensed dose for analysis. In some cases the test will specify that the dose chosen for analysis is not the first dispensed by the inhaler but, say, the fiftieth. In this case, forty nine waste doses will have to be fired from the inhaler before the fiftieth dose is collected. Testing can in principle be carried out manually, which requires an operative to repeatedly shake and fire inhaler devices. This of course is labour intensive, particularly as significant numbers of sample inhalers may need to be tested. There is consequently a need to automate the test firing process, which involves both shaking the inhaler and then suitably actuating it to cause firing, as well as arranging for collection of the test doses.

It is also desirable to be able to closely monitor, adjust and record the conditions of such tests—the shaking motion of the inhaler in particular—to ensure that the tests are being carried out in a reproducible manner and provide a meaningful simulation of real operating conditions. There have been devices constructed in the past which were capable of shaking inhalers, but these are believed typically to have used mechanisms using an electric motor and belt drive so that accurate control and recordal of the shake profile was not available.

In accordance with the first aspect of the present invention, there is a device for automatically shaking and firing an inhaler for medicament delivery, the device comprising a guideway, a carriage mounted upon the guideway for linear movement upon it, the carriage being adapted to receive and releasably mount the inhaler, and a linear motor operatively coupled to the carriage for reciprocally driving it to shake the inhaler.

BRIEF DESCRIPTION OF THE DRAWINGS

Specific embodiments of the present invention will now be described, by way of example only, with reference to the accompanying drawings in which:—

DETAILED DESCRIPTION OF THE DRAWINGS

Figure 1A:
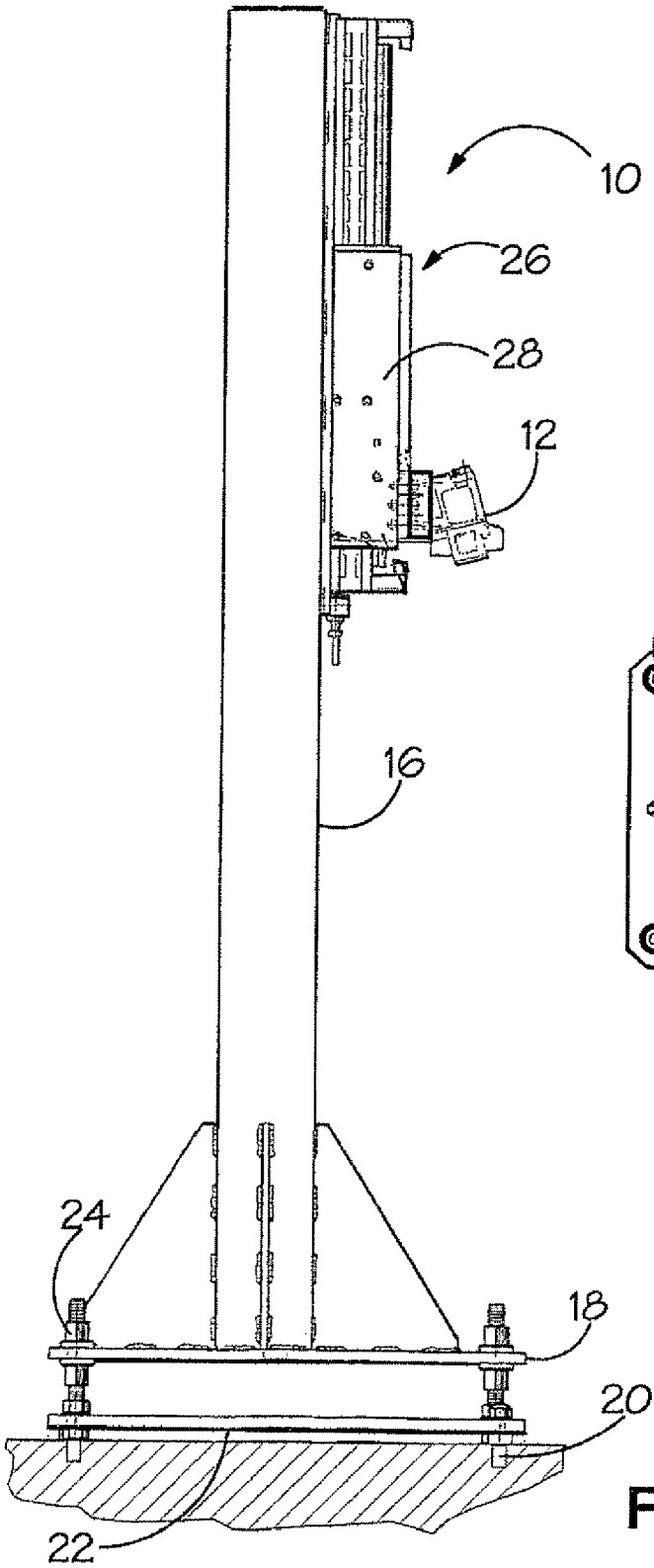
FIG. 1*a* is a side view of a shake device embodying the present invention.
Figure 1B:
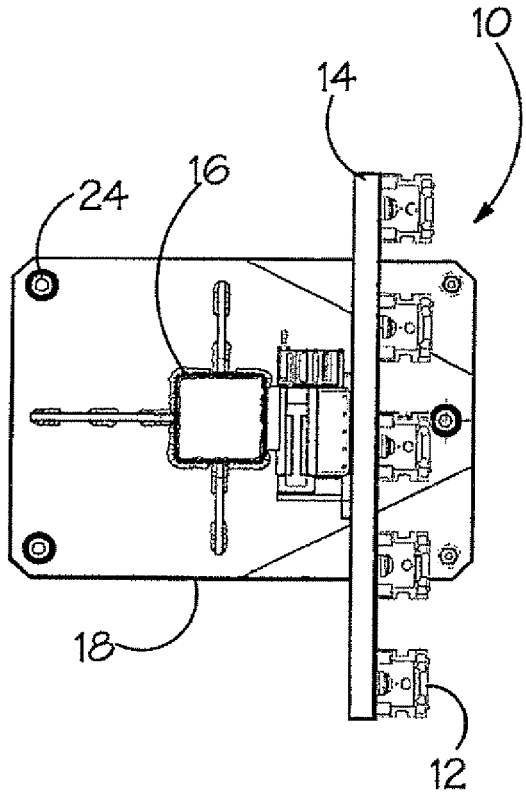
FIG. 1*b* is a plan view of the same shake device.
Figure 2:
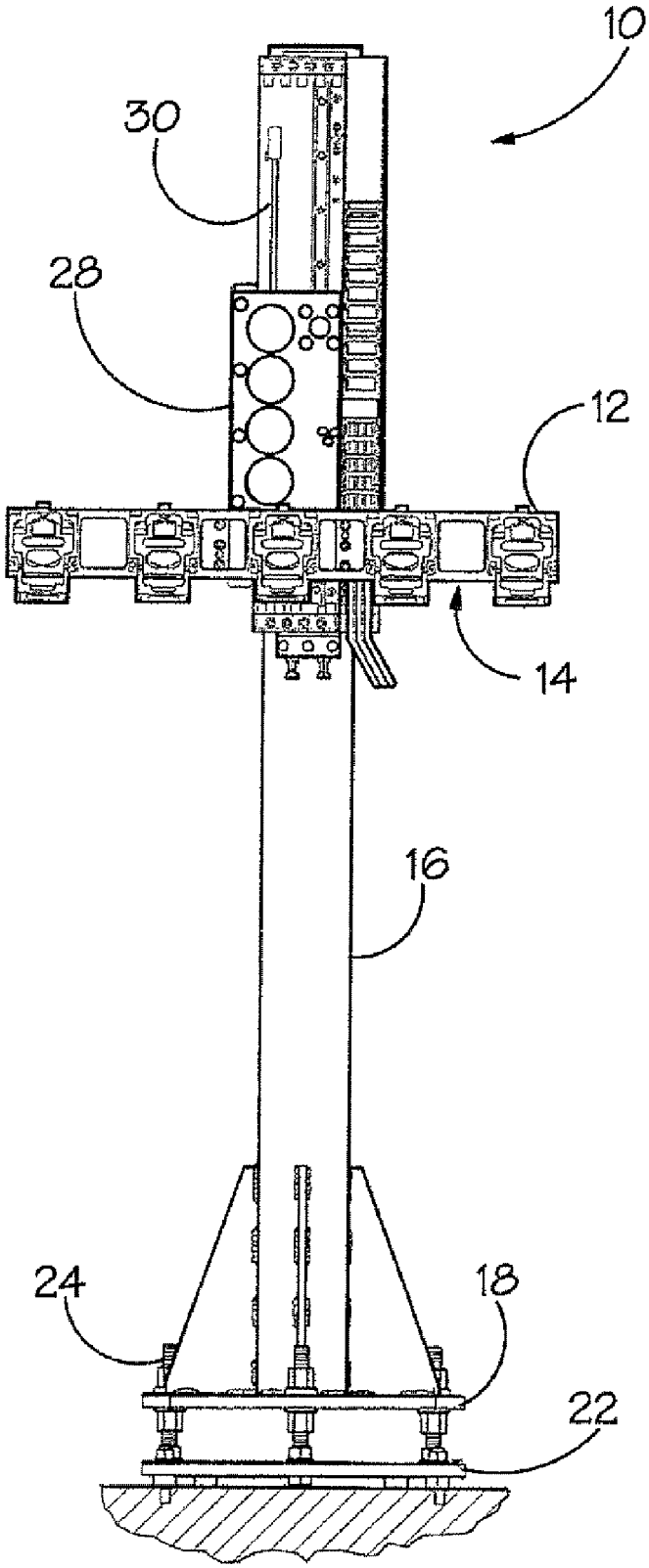
FIG. 2 is a front view of the same shake device.

The system illustrated serves to simulate the action of an inhaler user by first putting the inhaler through a shaking process in which it is moved reciprocally along a linear path, and then actuating the release device of the inhaler to cause it to fire a dose of medicament. These functions are carried out by separate mechanisms: an inhaler shake device 10 and an inhaler fire device 10*a*. In the illustrated embodiment the two devices are constructed and mounted independently of one another, and can operate independently. However their motions are coordinated by a control system.

The inhalers themselves are not seen in the drawings but are to be received in respective mounting frames 12 carried upon a movable carriage 14. The carriage is supported by an upright pillar 16 which is in this embodiment directly floor mountable by means of bolts 20 passing into a floor mounted plate 22. The upright pillar 16 incorporates plate 18 and an arrangement of studs, spherical seat nuts and spherical seat washers (collectively identified 24) which allows pillar 16 to be adjusted in position and angle.

Mounting the shaking device directly upon the floor in this way reduces any tendency for it to cause undesirable vibration of adjacent pieces of apparatus during the shake operation.

The carriage 14 is mounted upon a guideway carried on the pillar 16 to provide for linear motion, which in the illustrated embodiment is along the vertical direction. The guideway in this embodiment is formed as part of a linear motor 26, a traveler part 28 of which serves both to mount the carriage and to drive it during the shake operation. Linear motors are in themselves well known and are electric devices which provide controlled linear movement, when suitably driven through associated electronics.

A distance transducer is used in monitoring and recording motion of the carriage during the shake operation, inter alia in order to provide confirmation that a suitable shake profile was achieved. In this case the relevant transducer takes the form of a low voltage distance transducer which reads off a reflective strip within the linear motor 26.

In use, the shake device 10 is first loaded with a set of five inhalers which are then subject to a controlled shake operation by reciprocally driving the carriage 14. The actual shake profile can be closely controlled by means of the software used to drive the linear motor 26. The device is not for example limited to providing sinusoidal motion but could provide an approximation to a square wave, a saw tooth wave, etc., and nor need the wave form of the motion be consistently repeated—it could for example vary in amplitude or wave shape over time.

Figure 7:
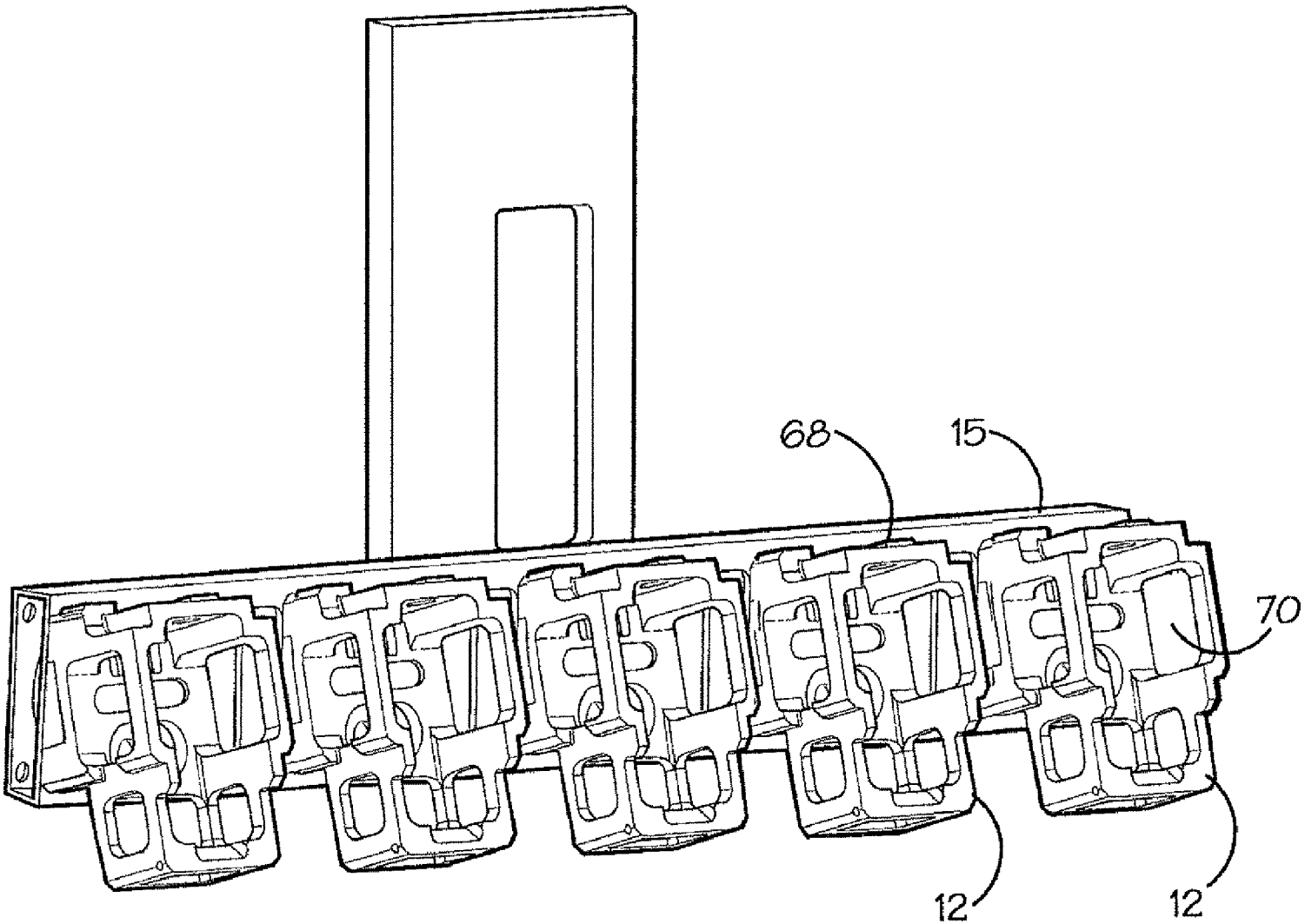
FIG. 7 is a perspective illustration of a set of mounting frames which serve to receive respective inhalers in use.

The carriage 14 is best seen in FIG. 7 and carries a set of mounting frames 12. The illustrated embodiment has five mounting frames 12, carried upon a channel sectioned mounting beam 15. Each mounting frame 12 defines a forwardly open box-like enclosure for receiving a respective inhaler (and once again the inhalers themselves are not shown). The profile defined by each mounting frame, which has a narrow section toward the bottom, a broader intermediate section, and a short narrowed top section, is chosen to compliment that of the body of the inhaler device itself and to securely mount it. Spring biased ball catches can just be seen at 68 and serve to releasably locate the inhalers. A user can snap fit the inhaler into a mounting frame 12 simply by pressing it home, and removing it is the reverse process. The mounting frames 12 are cut away in various places to reduce weight—the carriage must of course be reciprocally driven—and have openings such as 70 through which the actuating fingers 54, 56 project to engage with the inhaler.

Figure 9:
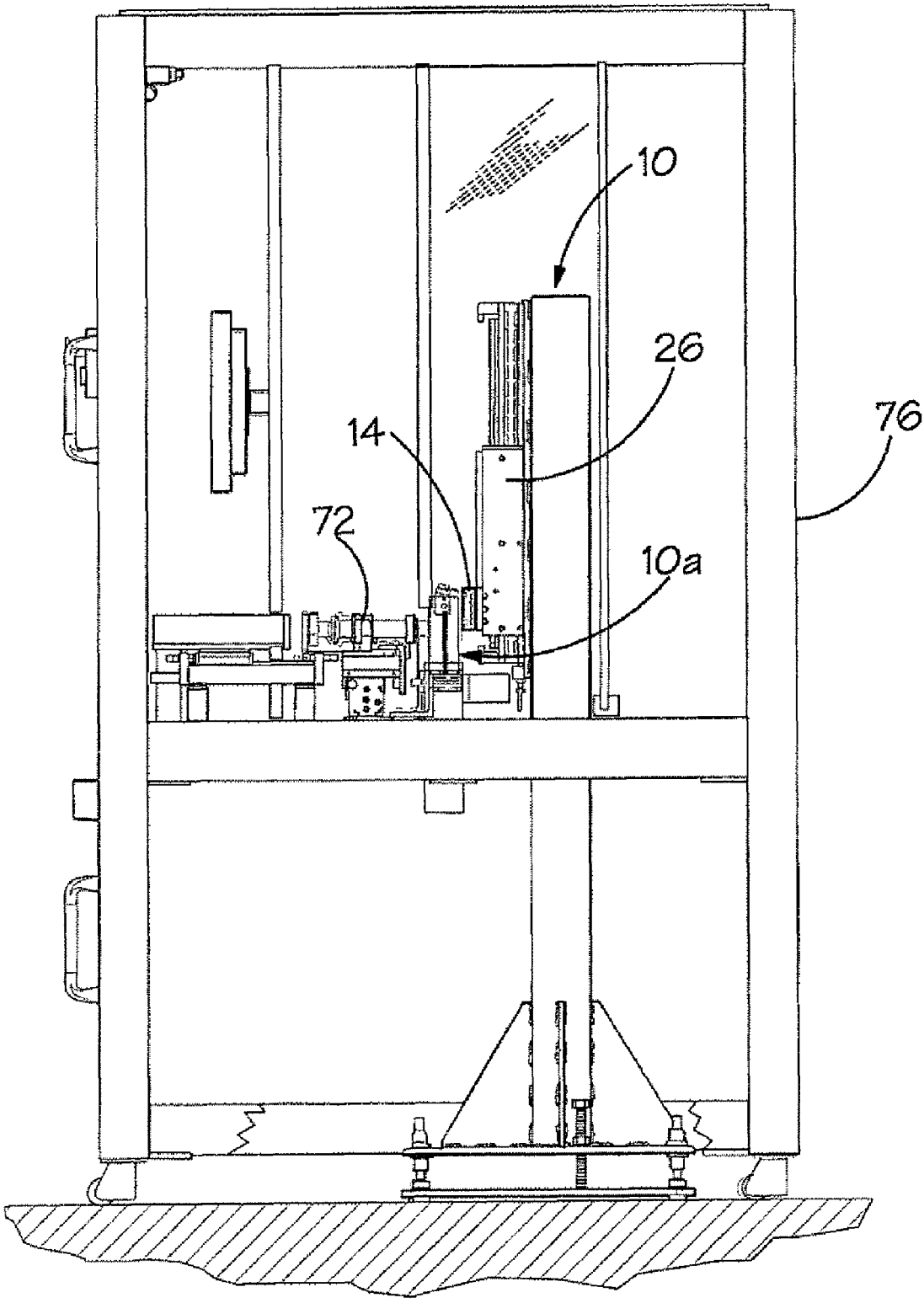
FIG. 9 shows the same testing apparatus from one end.

The firing device 10*a* is seen in FIG. 9 to be mounted toward the lower end of the travel of the carriage 14, so that inhalers mounted on the carriage 14 can be presented to it for firing. The structure and mechanism of fire device 10*a* will now be described with particular reference to FIGS. 3-6. The fire device 10*a* serves in particular to mechanically actuate the firing mechanisms of the five inhalers concurrently, to provide for the actual test firing.

Figure 3:
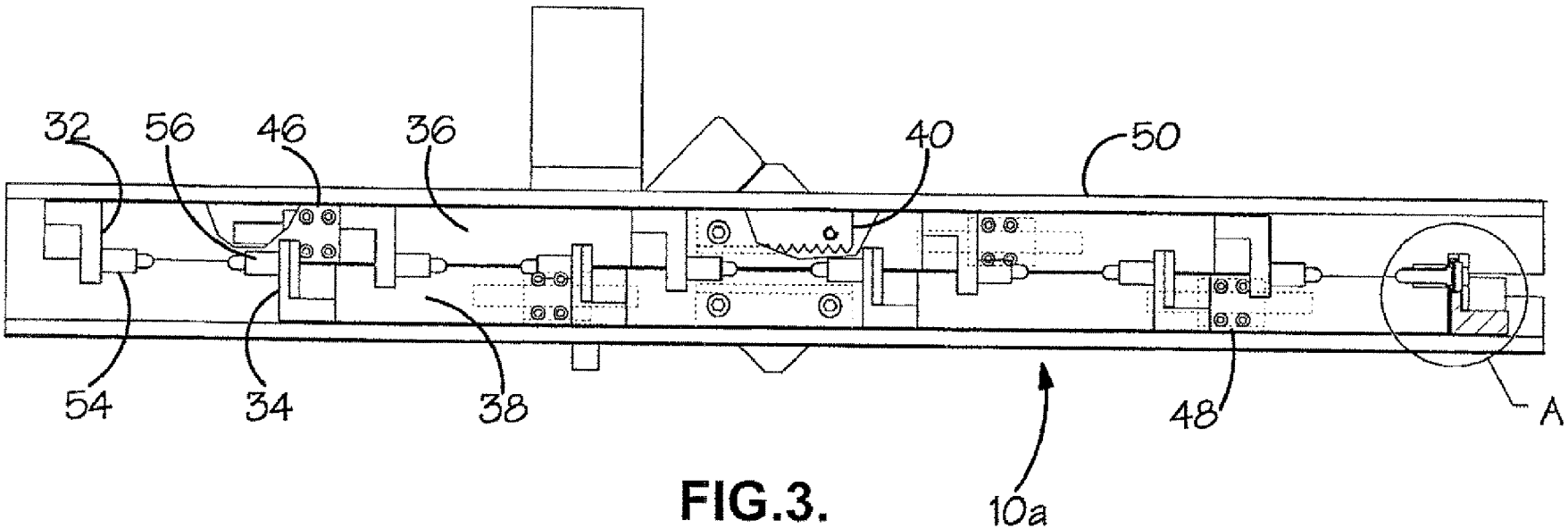
FIG. 3 is a plan view of a fire device, partially cut away to reveal certain aspects of the firing mechanism.

By moving the carriage 14 downward into alignment with the fire device 10*a*, each inhaler, still mounted in its frame 12, is positioned between a respective pair of movable arms such as 32 and 34. Each such pair comprises one arm 32 which is carried on a first sliding beam 36 and another arm 34 carried upon a second sliding beam 38. A rack and pinion mechanism is provided for driving the first and second sliding beams 36, 38 concurrently and in opposite directions. FIG. 3 is partially cut away to reveal a toothed rack 40 carried by the first, upper, sliding beam 36. It is to be understood that the second sliding beam has a similarly formed rack, whose teeth face upwardly, although this is not seen in the drawing. The racks are driven by a pinion indicated at 42 in FIG. 4, in phantom, which in its turn is rotationally driven by an electric motor and gearbox 44. It will be apparent that driving the pinion in one direction causes the first sliding beam to move to the right in the drawings and the second sliding beam to move to the left, bringing pairs of movable arms 32, 34 toward each other, whilst driving the pinion in the opposite direction reverses the travel and moves the pairs of arms away from each other. Linear bearings such as 46 and 48 serve to mount the first and second sliding beams 36, 38 and to permit their motion, and the sliding beams are carried by a channel sectioned mounting beam 50.

Motion of the sliding beams 36, 38 is monitored by means of a distance transducer 52, formed in this embodiment as a low voltage distance transducer.

Figure 6:
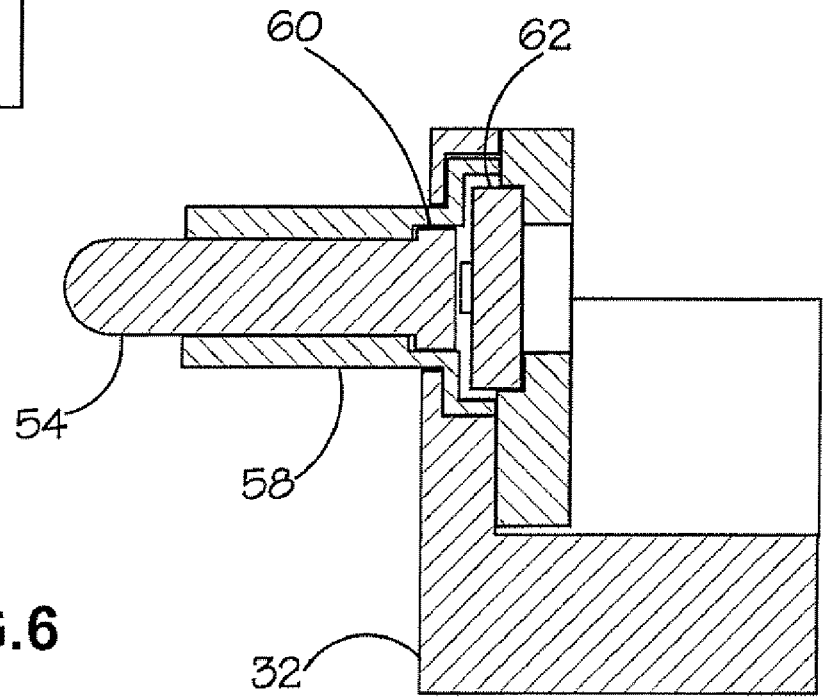
FIG. 6 shows, to an enlarged scale, a load sensing arrangement seen in circle A in FIG. 3.

Each of the movable arms such as 32 and 34 carries a respective actuating finger such as 54, 56, and it is these fingers which engage with the respective inhalers to fire them. The illustrated device is intended for use with the type of inhaler described in PCT/GB2006/000966. Recall that firing of this particular device requires it to be squeezed, to move a pair of pivotally mounted arms inwardly. When the pinion 42 is driven to move the arms such as 32 and 34 toward each other, a suitable squeezing action is provided. Provision is made to monitor the force thereby applied to the inhaler. In the present embodiment, one of each opposed pair of actuating fingers 54 is movably mounted, and the force applied to it is reacted to the corresponding arm such as 32 through a load cell. FIG. 6 shows the relevant construction to an enlarged scale. The actuating finger 54 is seen to be received as a sliding fit in a cylinder 58, and to be retained therein by engagement of an enlarged head 60 of the finger 54 with an undercut shoulder in the cylinder. The load cell is indicated at 62 and may for example be a piezoelectric device although other types of force transducer could be used. The operating stroke of the pressure transducer is preferably small, so that little compliance is introduced by it.

The monitoring of both the positions of the actuating fingers 54, 56 and the forces they exert makes it possible to record a complete profile of the actuation of the device, and to detect anomalies which might be indicative of a malfunction. Modern inhalers are typically intended to provide a predetermined, characteristic force/displacement profile. Deviation from the intended force profile is likely to be indicative of a malfunction and could be detected by the illustrated device. Recordal and analysis of the force profile is carried out by an associated digital computer which receives signals from the relevant transducers.

The fire device 10*a* has sensors for detecting whether inhalers are actually present at all in five of the sites where they are expected. In the illustrated embodiment these are formed as reflective optical sensors 64, which are carried upon the channel member 50 and face toward the sites between pairs of movable arms such as 32 and 34.

Figure 4:
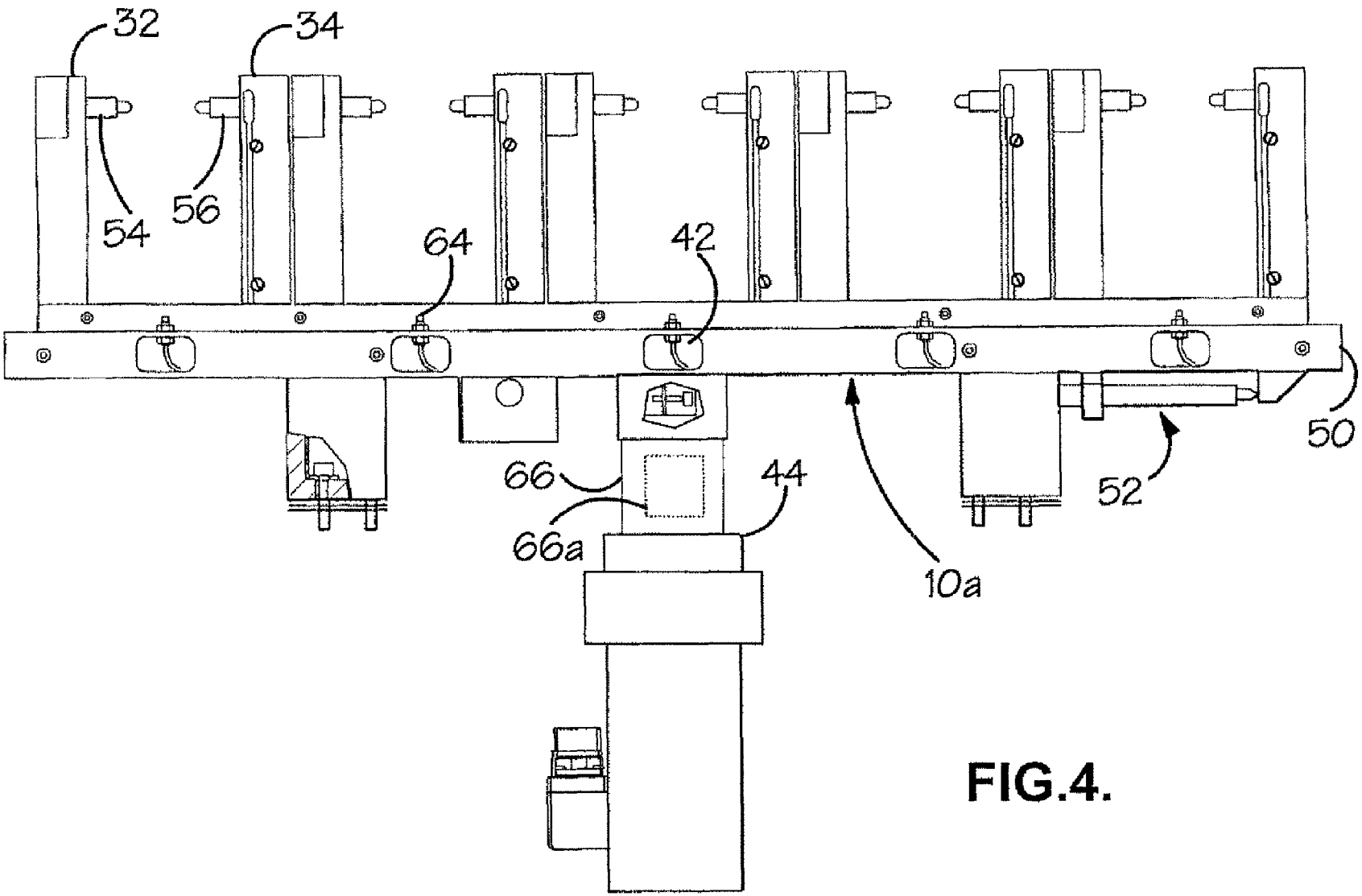
FIG. 4 corresponds to FIG. 3 but shows a front view of the fire device.
Figure 5:
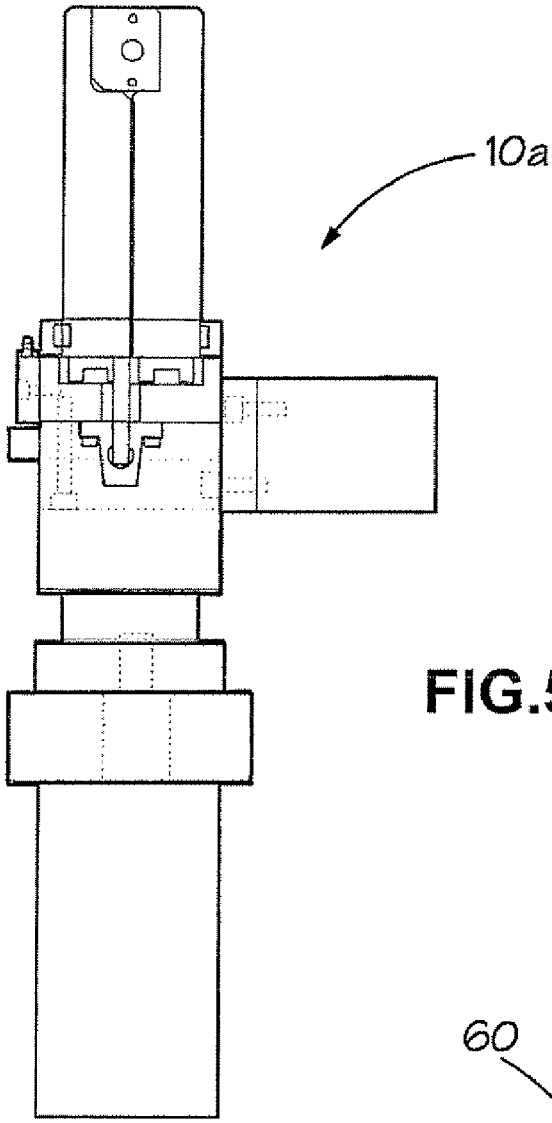
FIG. 5 corresponds to FIG. 3 but shows the fire device from one end.

Trials have shown that is desirable to electrically isolate the electric motor/gearbox 44 to prevent electrical noise which might otherwise disrupt readings from the load cells 62, etc. The motor's electrically isolating components 66 and 66*a* are illustrated in FIG. 4.

Figure 8:
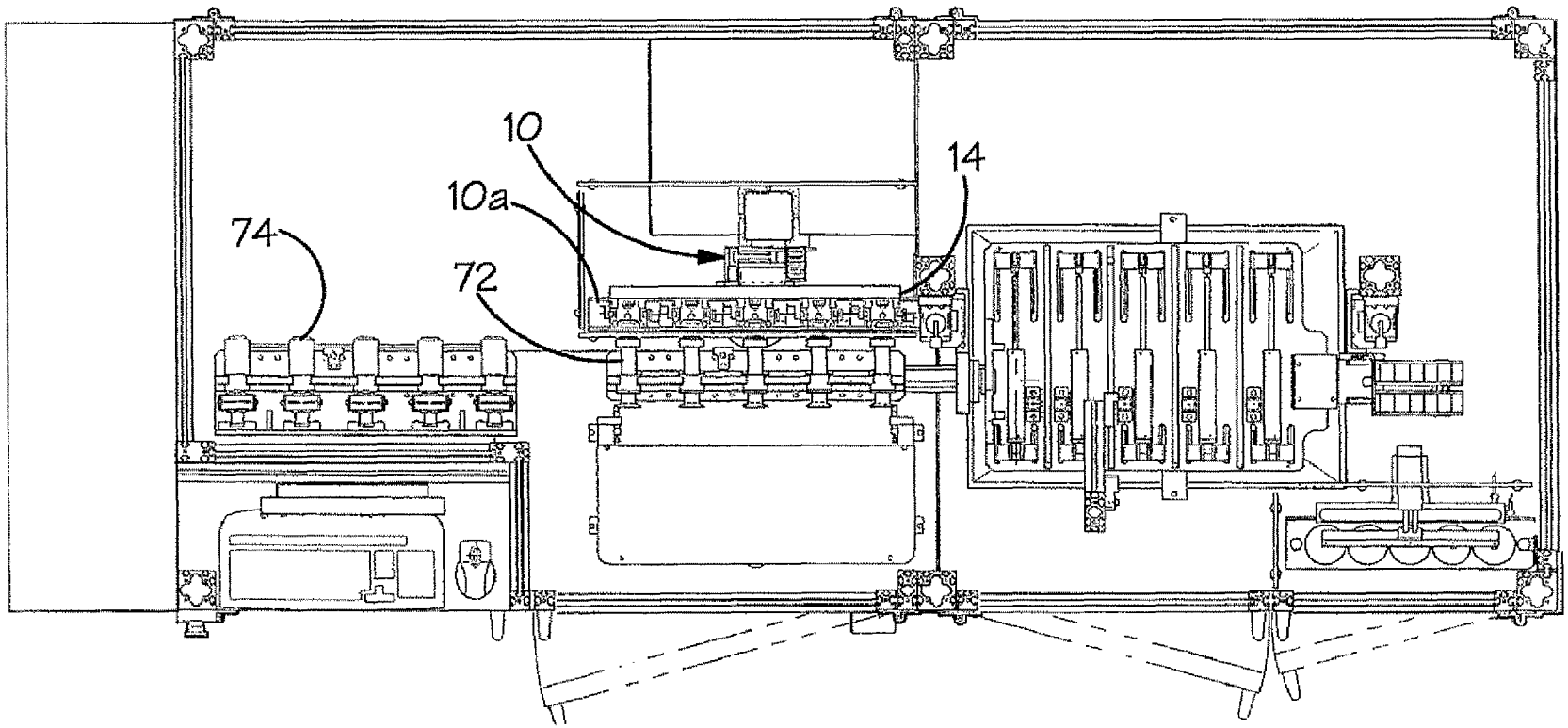
FIG. 8 shows a testing apparatus incorporating the shake and the fire devices in plan.
Figure 10:
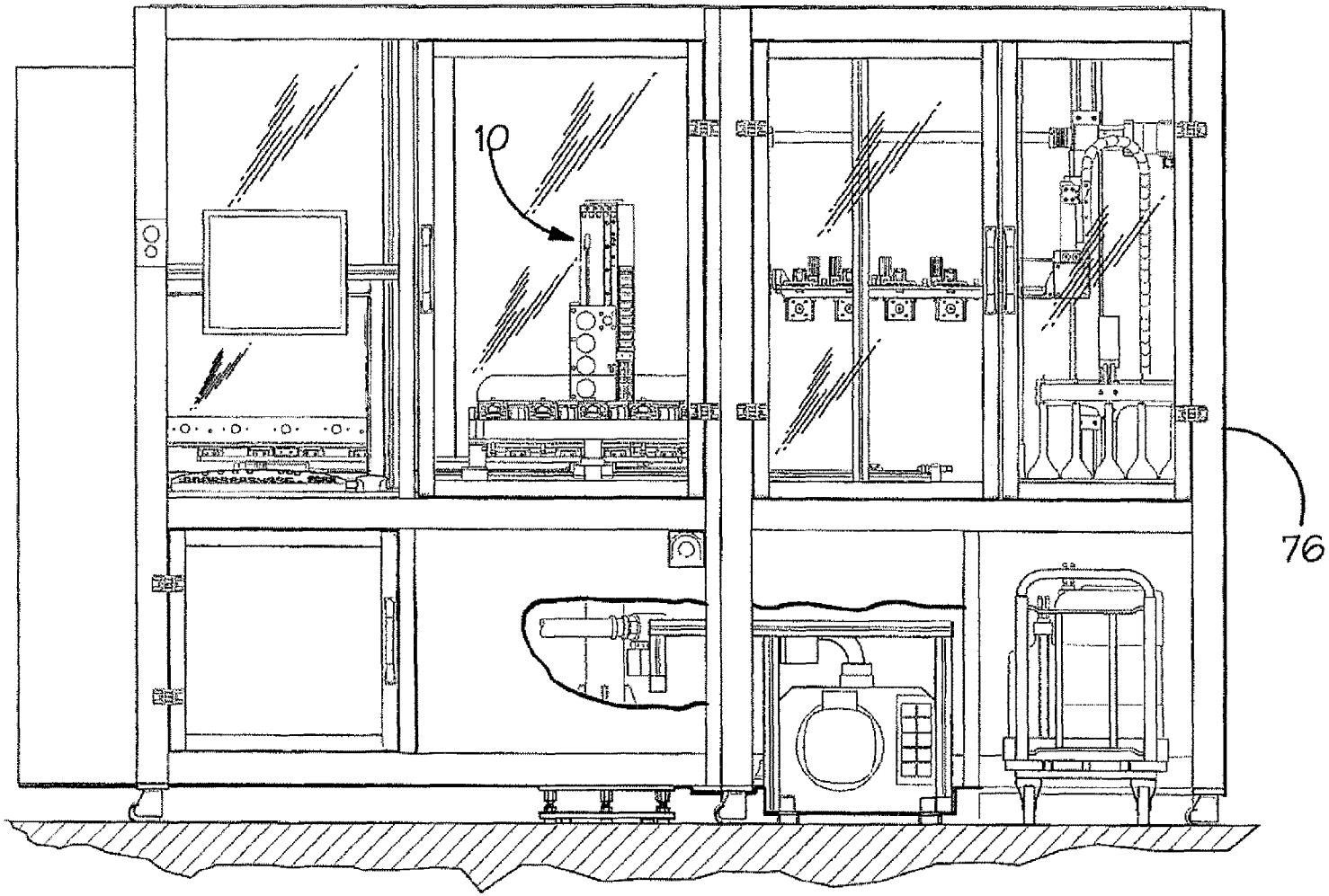
FIG. 10 shows the testing apparatus viewed from the front.

In order to automate the entire process of taking the required samples from the inhalers, an arrangement is needed not only to shake and fire them, but also to collect the dose of medicament which they discharge. FIGS. 8-10 illustrate a complete apparatus for this function which includes not only the shake device 10 and the fire device 10*a*, but also two sets of intakes—collection intakes 72 and waste intakes 74. Each of these sets includes a respective intake for each inhaler carried upon the carriage 14, so that in the present embodiment there are five of each. In FIG. 8, the collection intakes 72 are seen to be positioned for alignment with the inhalers carried upon the carriage 14 (the inhalers themselves being omitted from the drawings as before, but the spaces defined for them upon the carriage being discernable). The carriage 14 is vertically positioned, by means of the linear motor 26, in alignment with the fire device 10*a* and in line with the intakes 72 as can be seen from FIG. 9. Robotic actuators are provided to advance/withdraw the intakes 72, 74 toward/away from the carriage 14, and for biasing the intakes into engagement with the inhaler mouthpieces to form a seal between them. In practice the sequence of operations is that the inhalers are first shaken, and then the carriage and the intakes are positioned to align with one another and the intakes advanced so that each forms a seal against the mouthpiece of its respective inhaler. The inhalers are then fired in the manner described above and the discharged dose of medicament is drawn from the inhaler and captured and retained within the intake 72. In the present embodiment this is achieved by air drawn through the intakes although other approaches could be adopted. The medicament is thereby collected for subsequent analysis.

As noted above, test protocols may stipulate that only certain doses are required for analysis—say the fiftieth discharged from the inhalers—so that other, waste, doses need to be fired and safely disposed of before the chosen doses can be collected for analysis. For this purpose, robotic actuators are provided for moving the collection intakes away from the area of the carriage 14 and aligning instead the waste intakes 74 with the inhaler mouthpieces in this area. The waste intakes 74 function in essentially the same manner as the collection intakes 72 except that the material withdrawn through them is not collected for analysis but is simply discharged into a waste collection receptacle for disposal.

For the sake of safety, the entire apparatus is housed in a transparent-walled enclosure 76.

What is claimed:

1. A system for automatically shaking and firing an inhaler for medicament delivery, the system comprising a shake device for automatically shaking the inhaler, the device comprising a guideway, a carriage mounted upon the guideway for linear movement upon it, the carriage being adapted to receive and releasably mount the inhaler, and a linear motor operatively coupled to the carriage for reciprocally driving it to shake the inhaler, and a fire device comprising at least one movable firing member positioned to engage with an inhaler mounted in the carriage and to actuate its firing mechanism.

2. The system as claimed in claim 1 in which the carriage is adapted to concurrently receive and mount multiple inhalers.

3. The system as claimed in claim 1 in which the shake device comprises an electronic controller for controlling the linear motor to provide a predetermined form of reciprocal carriage motion.

4. The system as claimed in claim 3 in which the shake device further comprises a linear sensor for sensing carriage position.

5. The system as claimed in claim 4 in which the shake device further comprises means for recording carriage motion.

6. The system as claimed in claim 1 in which the carriage carries at least one mounting frame forming an enclosure to receive and locate an inhaler.

7. The system as claimed in claim 6 in which each of the mounting frame has a catch device, with which the inhaler is engageable by pressing it home in the enclosure, to releasably retain the inhaler.

8. The system as claimed in claim 1 in which the fire device is arranged so that by moving the carriage to a predetermined position on its guideway the inhaler mounted thereupon is presented to the fire device for firing.

9. The system as claimed in claim 1 in which the fire device comprises a powered arrangement for advancing/withdrawing the firing member.

10. The system as claimed in claim 9 in which the fire device comprises a transducer for measuring the force applied by the firing member.

11. The system as claimed in claim 10 in which the fire device further comprises means for storing measurements of firing member force.

12. The system as claimed in claim 9 in which the powered arrangement comprises an electric motor for driving a pinion which engages with a rack for advancing/withdrawing the firing member.

13. The system as claimed in claim 9 in which the fire device comprises an opposed pair of firing members, the powered arrangement being adapted to drive the opposing pair of firing members concurrently in opposite directions.

14. A shake device for automatically shaking an inhaler for medicament delivery, the device comprising a guideway, a carriage mounted upon the guideway for linear movement upon it, the carriage being adapted to receive and releasably mount the inhaler, and a linear motor operatively coupled to the carriage for reciprocally driving it to shake the inhaler, and a device for recording carriage motion.

15. A shake device as claimed in claim 14 comprising an electronic controller for controlling the linear motor to provide a predetermined form of reciprocal carriage motion.

16. A shake device as claimed in claim 14 which further comprises a linear sensor for sensing carriage position.

* * * * *